US005886270A

United States Patent [19]

Wynn

[11] Patent Number: 5,886,270

[45] Date of Patent: Mar. 23, 1999

[54] ELECTORMECHANICAL TUNER FOR STRINGED INSTRUMENTS

[76] Inventor: David S. Wynn, 1901 Fountain View, Edmond, Okla. 73013

[21] Appl. No.: 832,736

[22] Filed: Apr. 4, 1997

Related U.S. Application Data

[60] Provisional application No. 60/015,749 Apr. 22, 1996.

[51] Int. Cl.[6] ..... G10D 3/00

[52] U.S. Cl. ..... 84/313; 84/454

[58] Field of Search ..... 84/313, 454, 297 R, 84/298, 307

[56] References Cited

U.S. PATENT DOCUMENTS

| | | | |
|---|---|---|---|
| 4,375,180 | 3/1983 | Scholz | 84/454 |
| 4,909,126 | 3/1990 | Skinn et al. | 84/454 |
| 4,939,971 | 7/1990 | Satoh | 84/313 |
| 5,103,708 | 4/1992 | Steinberger | 84/297 R |
| 5,390,579 | 2/1995 | Burgon | 84/313 |
| 5,477,765 | 12/1995 | Dietzmann | 84/313 |

*Primary Examiner*—Cassandra C. Spyrou
*Attorney, Agent, or Firm*—Robert K. Rhea

[57] ABSTRACT

An automatic tuning system for a stringed instrument is formed by a microprocessor operating hardware connected with one end portion of the several strings. The hardware principally comprises a reversible motor driving gears and a gear train selectively meshed by a solenoid for each string entrained over a saddle at the bridge position and underlying a double hinged tremolo system. An input sensor in the tuning module detects the tone of a plucked string and converts it to a square wave of the detected frequency, which is compared by the microprocessor with the closest adjacent intended frequency and energizes the solenoid for engaging the gear mechanism for tightening or loosening the string to obtain the required frequency. The user can override the automatic string tuning function for initially tightening a string or strings, and manually adjust the frequency of a string by a manually rotated knob on the head stock of the instrument.

3 Claims, 9 Drawing Sheets

FIG. 12
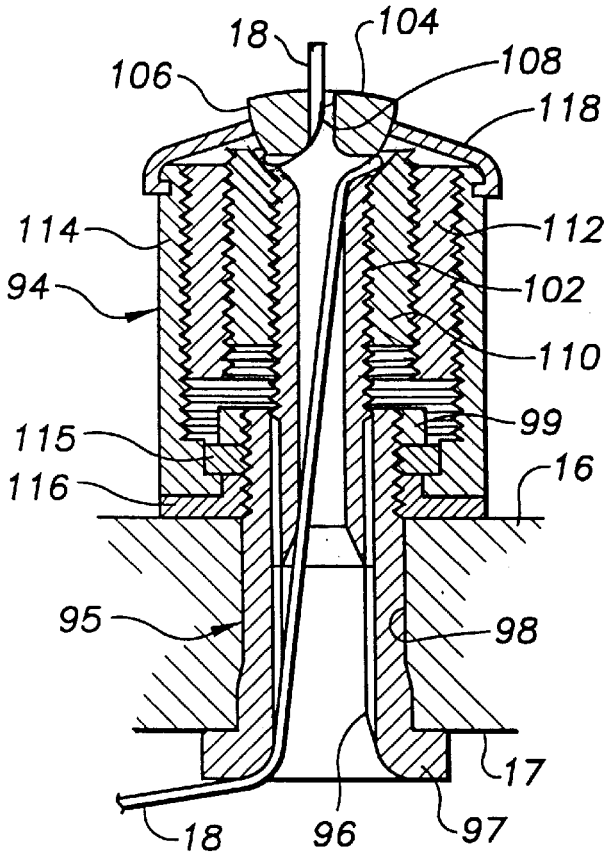
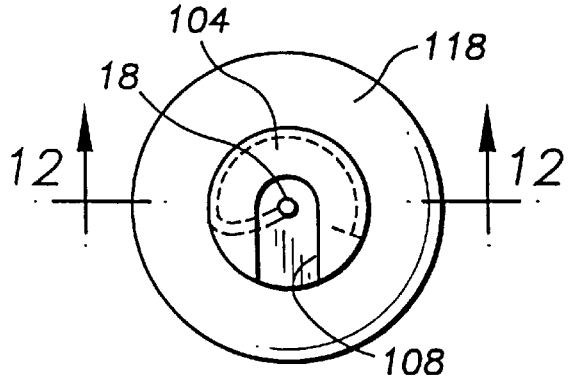
FIG. 11
FIG. 13
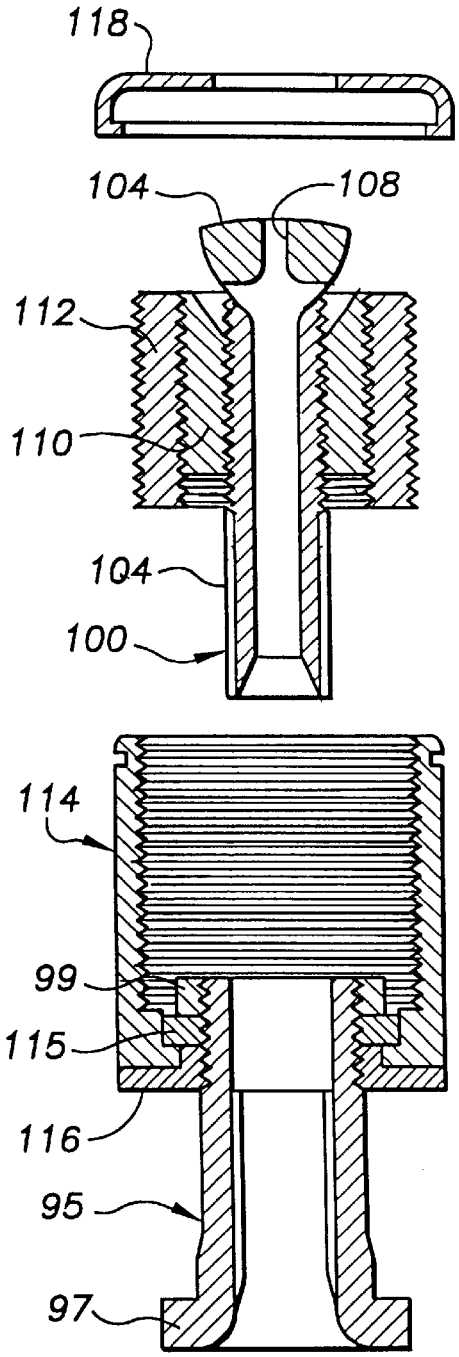

ELECTORMECHANICAL TUNER FOR STRINGED INSTRUMENTS

CROSS REFERENCE TO RELATED APPLICATION

This application claims the benefit of U.S. Provisional Application No. 60/015,749, filed Apr. 22, 1996.

STATEMENT REGARDING FEDERALLY SPONSORED RESEARCH OR DEVELOPMENT

Not applicable.

BACKGROUND OF THE INVENTION

This invention relates to stringed instruments such as an electric guitar and more particularly to an automatic string tuning device and tremolo system supported by the body of the stringed instrument.

SUMMARY OF THE INVENTION

In a stringed instrument, an on board microprocessor, when activated is responsive to the frequency of an out of tune selected and plucked string for energizing a solenoid, and meshing gears of a reversible motor driven gear train and rotating a threaded shaft operatively connected with one end of the selected string supported by a saddle for tensioning the string to a desired tuned frequency.

A tremolo mechanism including a base plate and a top plate fit on the top surface of the stringed instrument and are dual hinge mounted against upstanding pins fixed to the instrument. The base plate supports a plurality of string saddles, one for each string connected with the above described reversible motor driven gear train for tightening or loosening each individual string. A tremolo arm attached to the base plate when manually moved at one end toward the face of the instrument lifts the base and the top plate changing the tension of the several strings as a unit and returning the tremolo mechanism to its at rest position by a spring mechanism connected with the top plate biasing the tremolo mechanism downwardly into contact with the top surface of the stringed instrument.

Additionally, a compound locking screw tuning peg assembly mounted on the instrument head stock permits manually individually tensioning a string to near the desired frequency.

The principal objects of this invention are to: provide an automatic tuning system for the respective strings of a stringed instrument; maintain the remaining strings in tune in the event of a broken string; quickly place a replacement string in tune; permit manually initially tensioning a string or changing the tension of a string; and include an improved double hinged tremolo system.

BRIEF DESCRIPTIONS OF THE DRAWINGS

FIG. 11 is a top view of a locking screw tuning peg;

FIG. 12 is a vertical cross sectional view taken substantially along the line 12—12 of FIG. 11;

FIG. 13 is a partially exploded cross sectional view of the components illustrated by FIG. 12;

DESCRIPTION OF THE PREFERRED EMBODIMENTS

Figure 1:
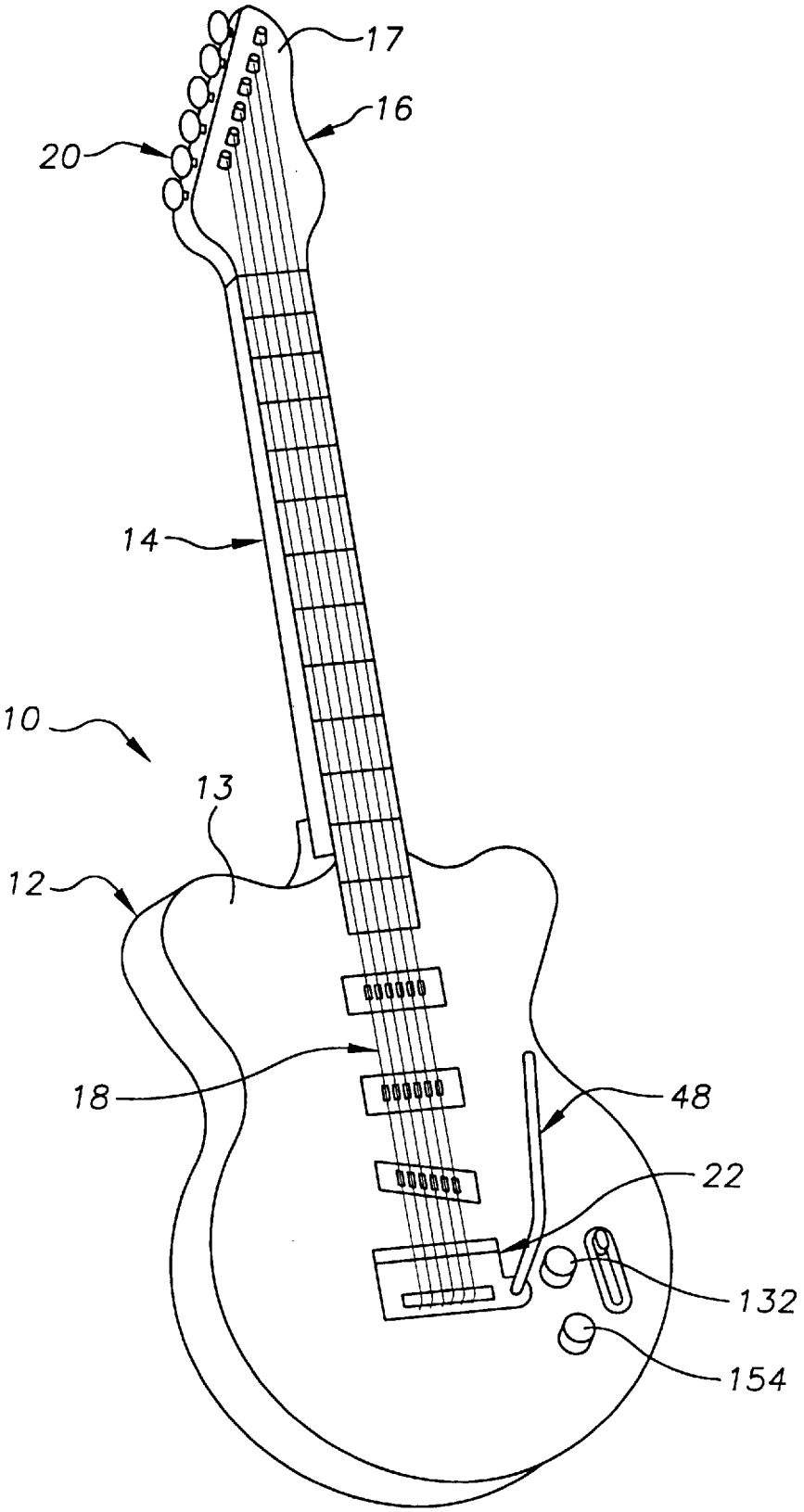
FIG. 1 is a perspective view of a guitar having the string tuning and tremolo assembly installed thereon.
Figure 2:
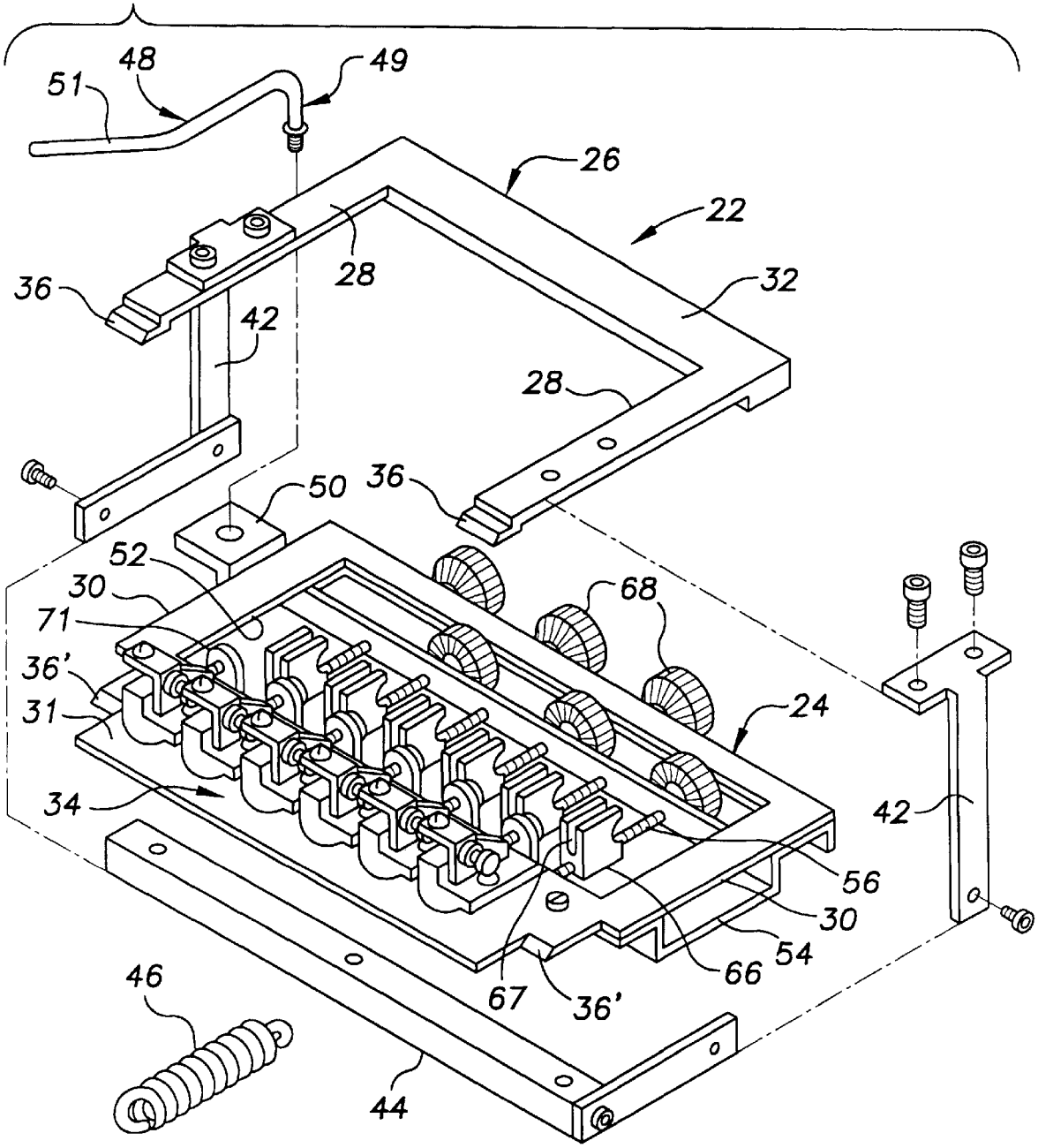
FIG. 2 is an exploded isometric view of a preferred embodiment of a double hinged tremolo system and string tuning mechanism.
Figure 3:
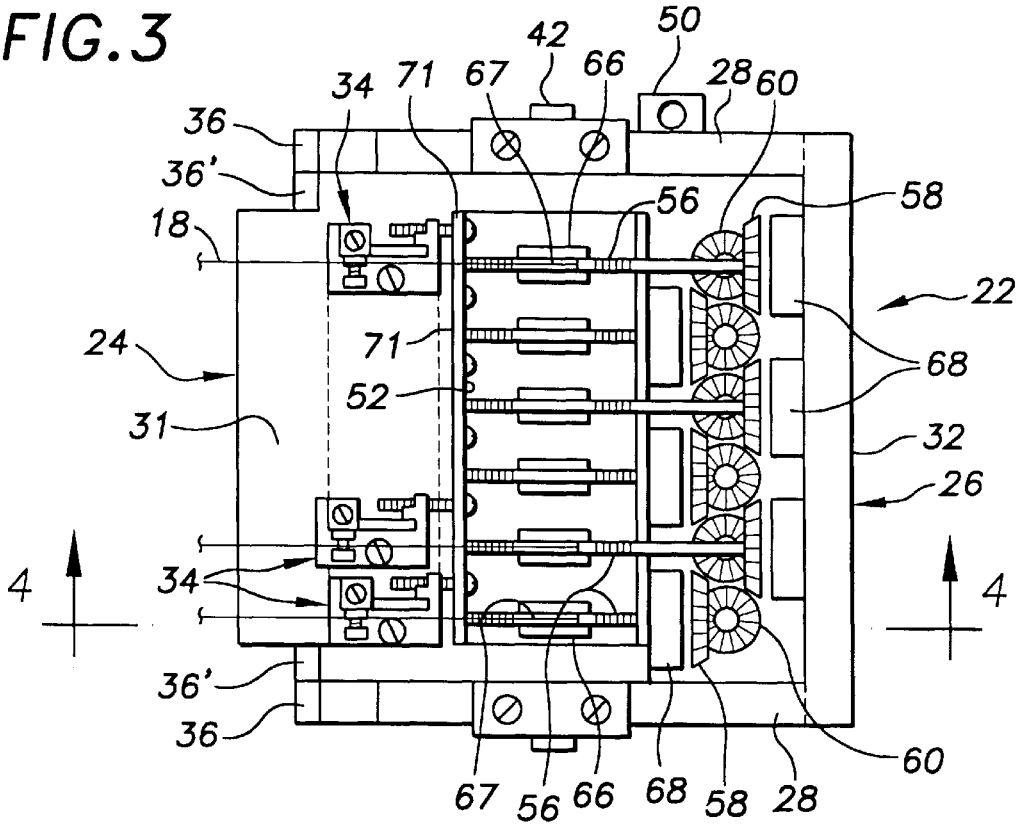
FIG. 3 is a top view of the assembled components of FIG. 2.
Figure 4:
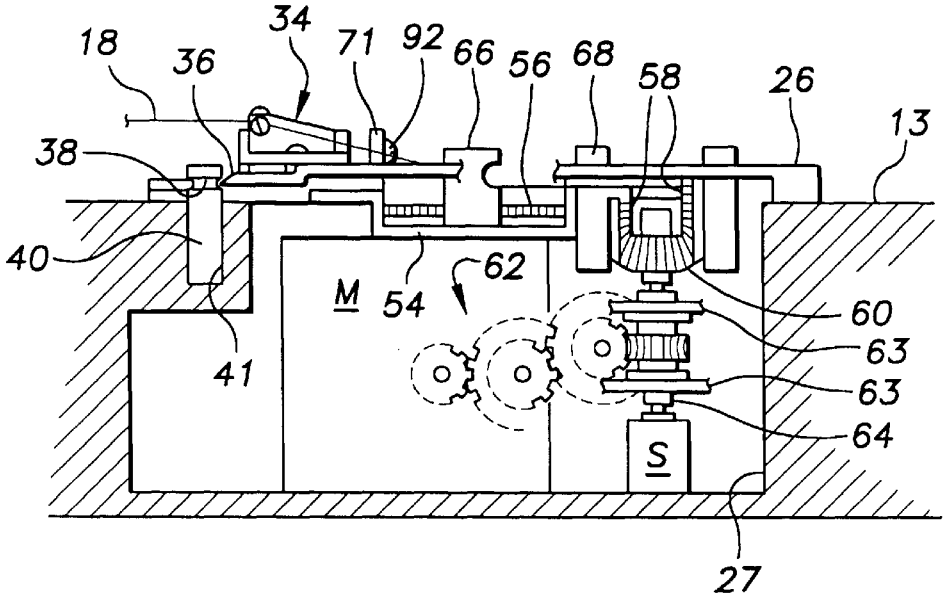
FIG. 4 is a vertical cross sectional view taken substantially along the line 4—4 of FIG. 3 and illustrating a fragment of the guitar body.
Figure 5:
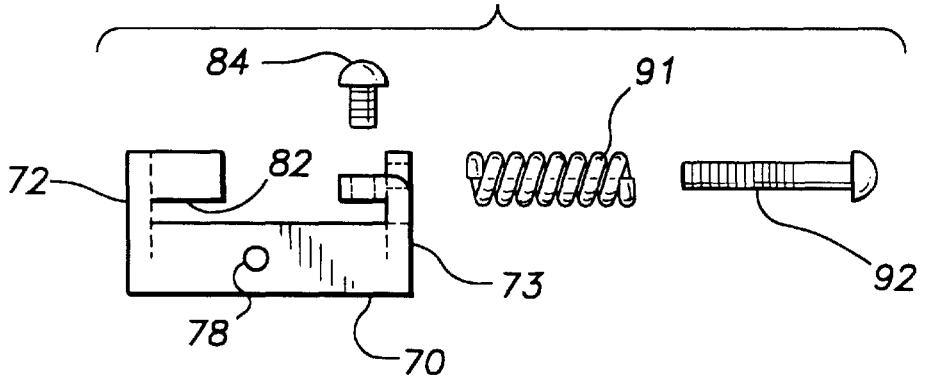
FIG. 5 is an exploded top view of a string saddle base plate.
Figure 6:
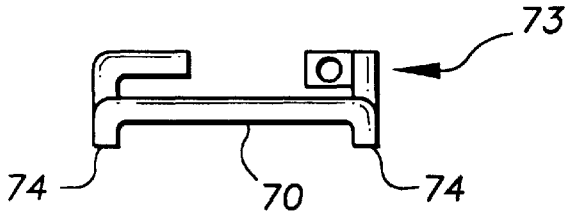
FIG. 6 is a side view of FIG. 5.
Figure 7:
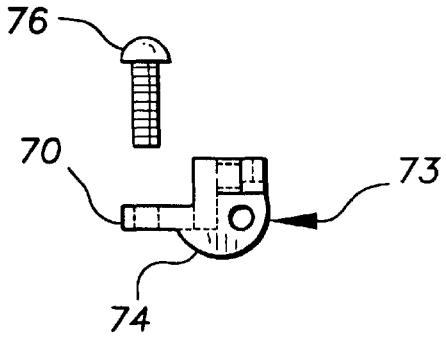
FIG. 7 is a right end elevational view of FIG. 6.
Figure 8:
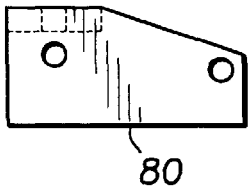
FIG. 8 is a side elevational view of a string supporting top section.
Figure 9:
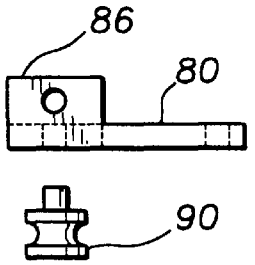
FIG. 9 is a top view of FIG. 8.
Figure 10:
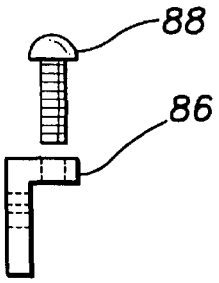
FIG. 10 is a right end elevational view of FIG. 8.

Like characters of reference designate like parts in those figures of the drawings in which they occur.

In the drawings:

Referring first to FIGS. 1 through 4, the reference numeral 10 indicates a substantially conventional guitar comprising a body 12 having a face surface 13, a neck 14 terminating in a head stock 16, and having a plurality (6) of strings 18 connected at one end portion with a like plurality of tuning pegs 20 and anchored at their other ends on a double hinged tremolo mechanism 22.

The tremolo mechanism 22 comprises a generally rectangular base plate 24 and a top plate 26 overlying a socket or well 27 (FIG. 4) formed in the guitar body 12 adjacent the anchored end portion of the several strings 18 and extending transversely of the longitudinal direction of the strings.

The top plate 26 is generally U-shaped having parallel legs 28 superposed on respective lateral side portions 30 of the base plate 24. The bight portion 32 of the top plate projects opposite the position of the several strings beyond the limit of the base plate 24 and overlies the body face surface 13.

The top planar surface 31 of the base plate 24 adjacent the several strings 18 is provided with a plurality (6) string saddles 34 for adjusting the rearward end portion of the several strings relative to each other and the base plate, as presently explained.

The downwardly offset forward end portions of the top plate legs 28 are provided with a transverse knife edge 36 cooperatively juxtaposed (FIG. 3) with similar cooperating knife edge surfaces 36' on lateral sides of the base plate 24. The knife edges 36–36' are partially nested in an annular groove 38 of a pair of anchor pins 40 vertically disposed in suitable sockets 41 formed in the surface of the guitar body 12 for vertical pivoting movement, as a unit, of the opposite end portions of the base 24 and top plate 26 about the vertical axes of the hinge pin anchors 40.

A pair of legs 42 depend from respective sides of the top plate 24 and are connected at their depending end portions with a crossbar 44, in turn connected with one end of a spring 46 anchored at its other end to the guitar body within the well 27 for biasing the base and top plates 24 and 26 downwardly after being lifted. An L-shaped tremolo arm 48 is connected by its threaded leg 49 with a laterally projecting lug 50 on the base plate 24. The leg 51 of the tremolo arm projects in the direction of the guitar neck as is conventional.

The base plate 24 is further characterized by a rectangular opening 52 extending transversely of the base plate between its forward saddle supporting surface or platform 31 and its opposite rearward end. A U-shaped channel 54 underlies the major forward portion of the base plate opening 52, and is secured by lateral flanged edge portions to the depending surface of the base plate. The upstanding legs of the channel 54 are horizontally line drilled in equal spaced relation to receive a plurality (6) of threaded shafts 56, one for each string of the stringed instrument. The rearward end portion of each shaft 56 is axially connected with a first bevel gear 58.

The first bevel gear 58 meshes with and is driven by a second bevel gear 60 when a reversible motor M and driven gear train 62, which may be a gearmotor, angularly rotates a gear shaft 64, supported normal to the instrument face surface 13 by gear train frame members 63, in response to a solenoid S energized to lift the pinion 60 into meshing engagement with the first bevel gear 58 which angularly rotates the threaded shaft 56. A rectangular threaded bore string anchor 66 longitudinally surrounds an intermediate portion of the respective threaded shaft 56 for longitudinal movement of the string anchor 66 toward and away from the respective ends of the threaded shaft 56 in response to the shaft direction of rotation. Each string anchor 66 is provided with a longitudinal upwardly open instrument string and knob end receiving slot 67 for tensioning the respective string by movement of the string anchor toward and away from the instrument neck 14. A knurled surface disk 68 axially secured to each spur gear 58 permits manual quickly tightening an instrument replacement string prior to the automatic tuning function of the device, as presently explained.

Referring also to FIGS. 5 through 10 each of the string supporting saddles 34 are identical and only one is described in detail in the interest brevity.

Each saddle 34 comprises a rectangular planar base 70 having upstanding and depending flanged end portions 72 and 73 at its respective ends normal to the longitudinal axis of the base 70. The depending edge of each flange 72 and 73 describes a semi-circular surface 74 on a selected radius, for the purposes presently explained.

The base 70 is cooperatively aligned longitudinally forward of an upstanding ear 71 (FIG. 3 & 4) on the forward edge limit of the base plate opening 52 for the purposes presently explained. A screw 76 (FIG. 7) in a threaded bore 78 raises and lowers the planar base 70 relative to the base plate 31, for the purpose presently explained.

A generally rectangular string support plate 80 is nested by its depending edge portion in a slot 82 at one side of the base 70 formed by confronting end surfaces of the respective base legs 72 and 73, and is secured therein by a pin 84. The string plate 80 has a laterally projecting wing 86 receiving a screw 88 which raises and lowers the end portion of the plate 80 opposite the pin 84 by pivoting about the axis of the latter. The forward end portion of the string plate 80 horizontally supports a laterally projecting spool 90 overlying the base 70.

The purpose of the spool 90 is to support an intermediate portion of the respective string when extended thereover and anchored by the string tensioning member 66 on a respective screw 56. An expansion spring 91, surrounding an adjusting screw 92 extending through the respective ear 71 at its head end portion and threadedly engaged at its other end portion with the base flange leg 73, moves the saddle assembly 34 forward and rearward by angular rotation of the screw 92 in respective directions. Movement of the entire saddle unit toward and away from the instrument neck affects the intonation of the respective string.

The tension of the respective string 18 biases the edge of the base 70 opposite the string support plate 80 toward contact with the top surface 31 of the base plate. As mentioned hereinabove, the screw 78 lifts the base 70 relative to the surface 31, and simultaneously moves the string laterally relative to an adjacent string or strings. Angular rotation of the string support plate screw 88 in one direction lifts the forward end portion of the plate 80 and string 18, and increases the tension on the string, or decreases it, as the screw is angularly rotated in the opposite direction.

Referring now to FIGS. 11 through 13, the numeral 94 indicates a locking compound screw assembly shown inverted from its installed position when replacing the tuning pegs 20 on the head stock 16. The screw assembly 94 comprises a base cylinder 95 having a splined bore 96, and one flanged end 97 for insertion into a suitable bore 98 in the head stock 16 with the flanged end 97 overlying the head stock face surface 17. The opposite end portion of the base cylinder 95 is provided with external threads for receiving a nut 99.

A sleeve-like cylinder 100 having external threads 102 at one end portion and a splined opposite end portion 104 is cooperatively received by the base cylinder splines 96. The wall of the end portion of the sleeve 100 opposite the splines 104 diverges arcuately outward and upwardly to form a head 104 having an arcuate peripheral surface 106 interrupted by a vertical slot 108 through the head communicating with its bore. An inner externally and internally threaded sleeve 110 surrounds and mates with the threads 102, and is provided at its end adjacent the head 104 with an arcuate dish surface mating with the arcuate head surface 106 for the purpose presently explained.

The outer threads of the sleeve 110 are left hand threads. Similarly, an intermediate sleeve 112 having internal left hand threads mating with the left hand threads of the inner sleeve 102, and outer right hand threads for mating with the internal threads of a knurled outer surface, manually angularly rotated sleeve 114 having a flanged end portion surrounding the threaded end portion of the base cylinder 95 between a pair of cooperating washers 115 and 116.

A centrally apertured resilient cap 118 overlies the screw assembly in surrounding relation with respect to the cylinder head 104.

A string 18 is connected with the screw assembly 94 by inserting the end opposite the tremolo anchored end portion through the flanged end of the base cylinder 95 and the bore of the cylinder 100 outwardly through slot 108. The free end of the string 18 out of the slot 108 is wrapped substantially 360 degrees around the periphery of the cylinder 100 between its threads and head end portion 104 extended upwardly through the slot 108. The outer cylinder 114 is manually angularly rotated clockwise which angularly rotates the inner and intermediate cylinders 110 and 112 counterclockwise, and moves the inner cylinder 110 toward the arcuate edge 106 of the head 104, to impinge the string 18 between the mating surfaces of the inner cylinder and the head 104. Further angular rotation of the outer cylinder 114 lifts the sleeve-like cylinder 100 with the inner and intermediate sleeves 110 and 112 to tension the string 18 as desired.

Figure 14:
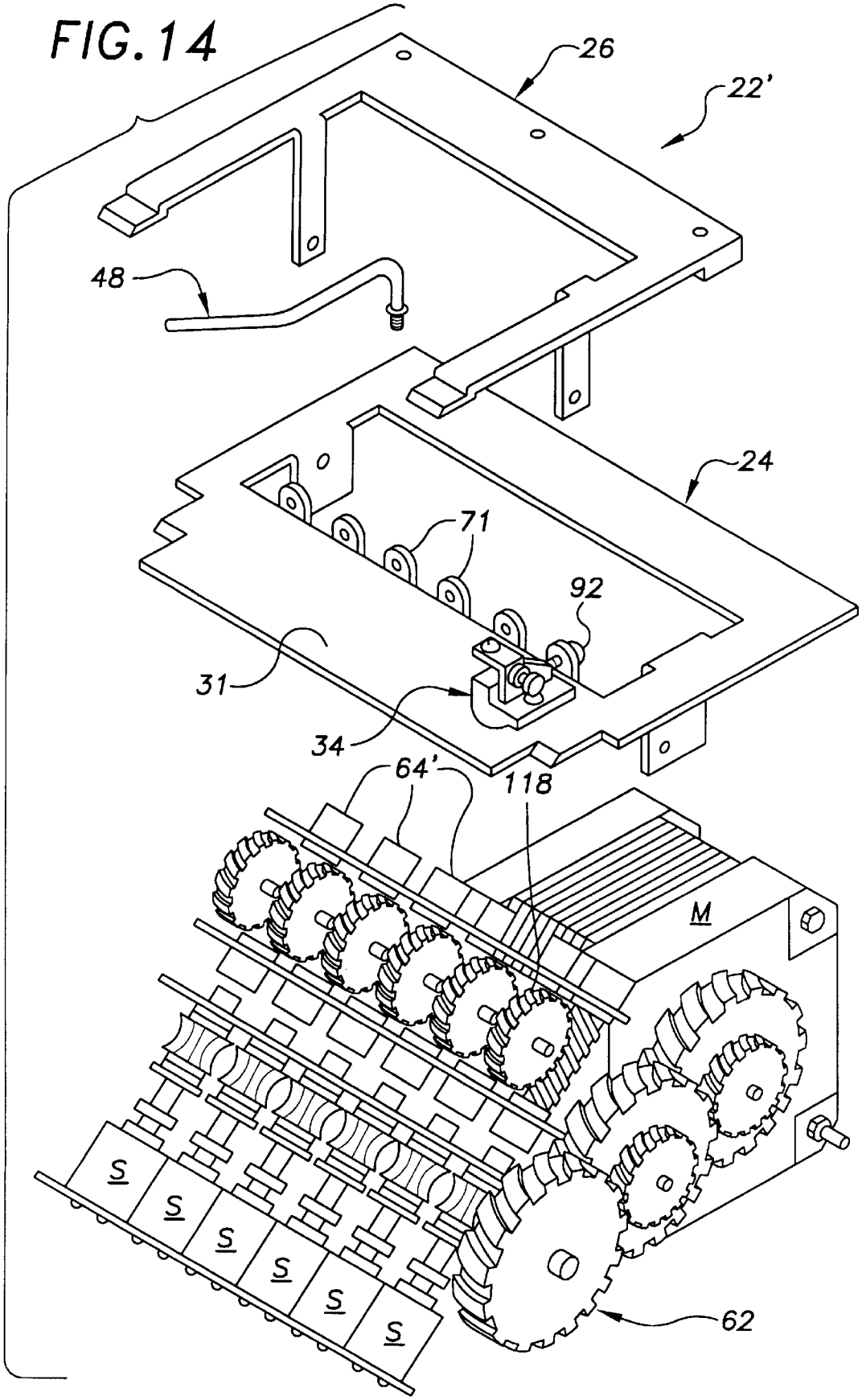
FIG. 14 is an exploded isometric view similar to FIG. 2 of another embodiment of the string tuning mechanism.
Figure 15:
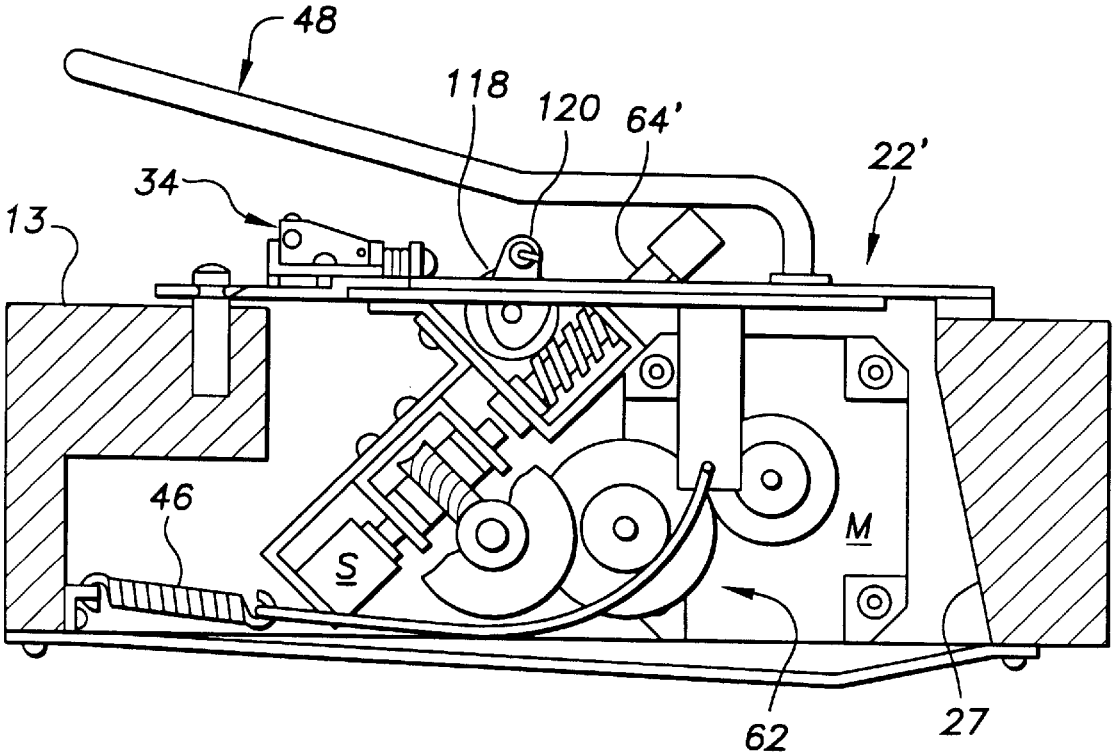
FIG. 15 is a vertical cross sectional view similar to FIG. 4 of the assembled components of FIG. 14.

Referring also to FIGS. 14 and 15, a modified tremolo system 22' is substantially identical with the above described tremolo system 22. The improvement comprises replacing the beveled gears 58 and 60 with an inclined, relative to the face surface 13, solenoid actuated shaft 64' angularly rotating a worm gear wheel 118 for moving a string anchor 120 toward and away from the instrument neck tensioning the respective string 18 by the motor driven gear train 62 angularly rotating the shaft 64' in a desired direction.

Figure 16:
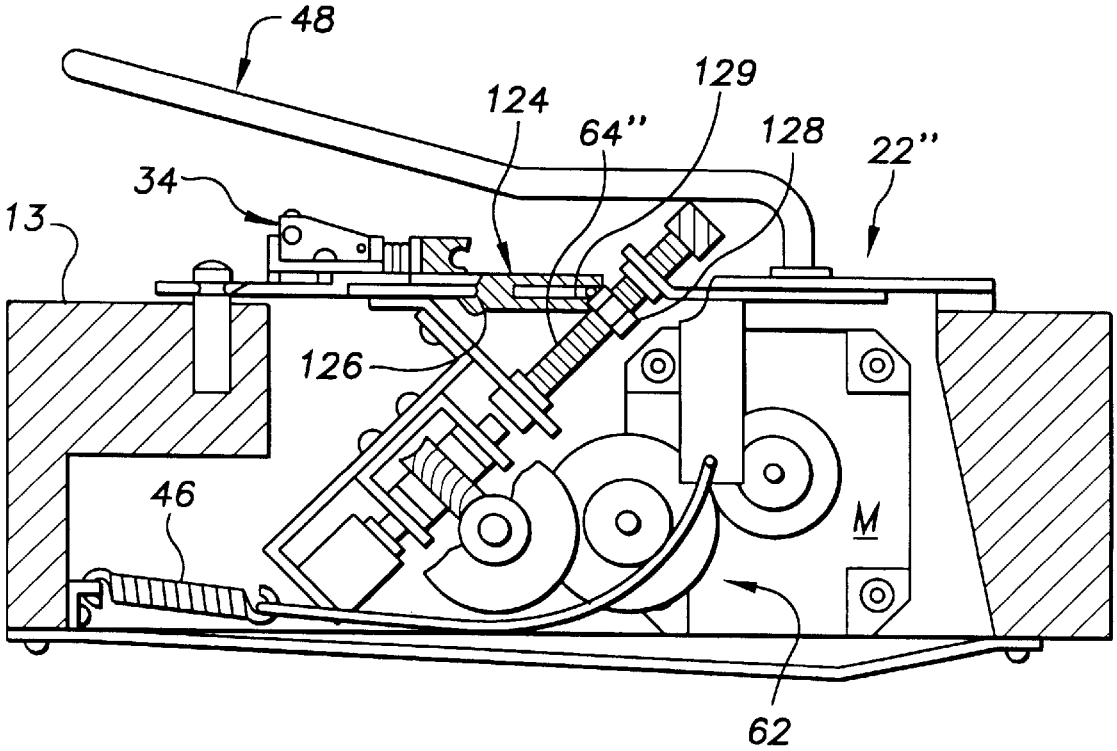
FIG. 16 is a view similar to FIG. 15 of a further embodiment.

FIG. 16 indicates a substantially identical tremolo and gear train system indicated by the numeral 22" in which the worn gear and string anchor 118 and 120 are replaced by a longitudinally and transversely slotted bar 124 vertically pivoted about the axis of a hinge pin 126 at its end opposite its slotted end portion.

The shaft 64 is modified, as at 64", to include an externally threaded shaft moving a nut 128 longitudinally of the shaft by angular rotation of the shaft in a given direction by the gear train 62. The nut 128 on the shaft 64" is pinned to the arm 124 and pivots the arm to move its string anchor slot 129 vertically which loosens or tensions the string 18, not shown, when attached thereto.

Figure 17:
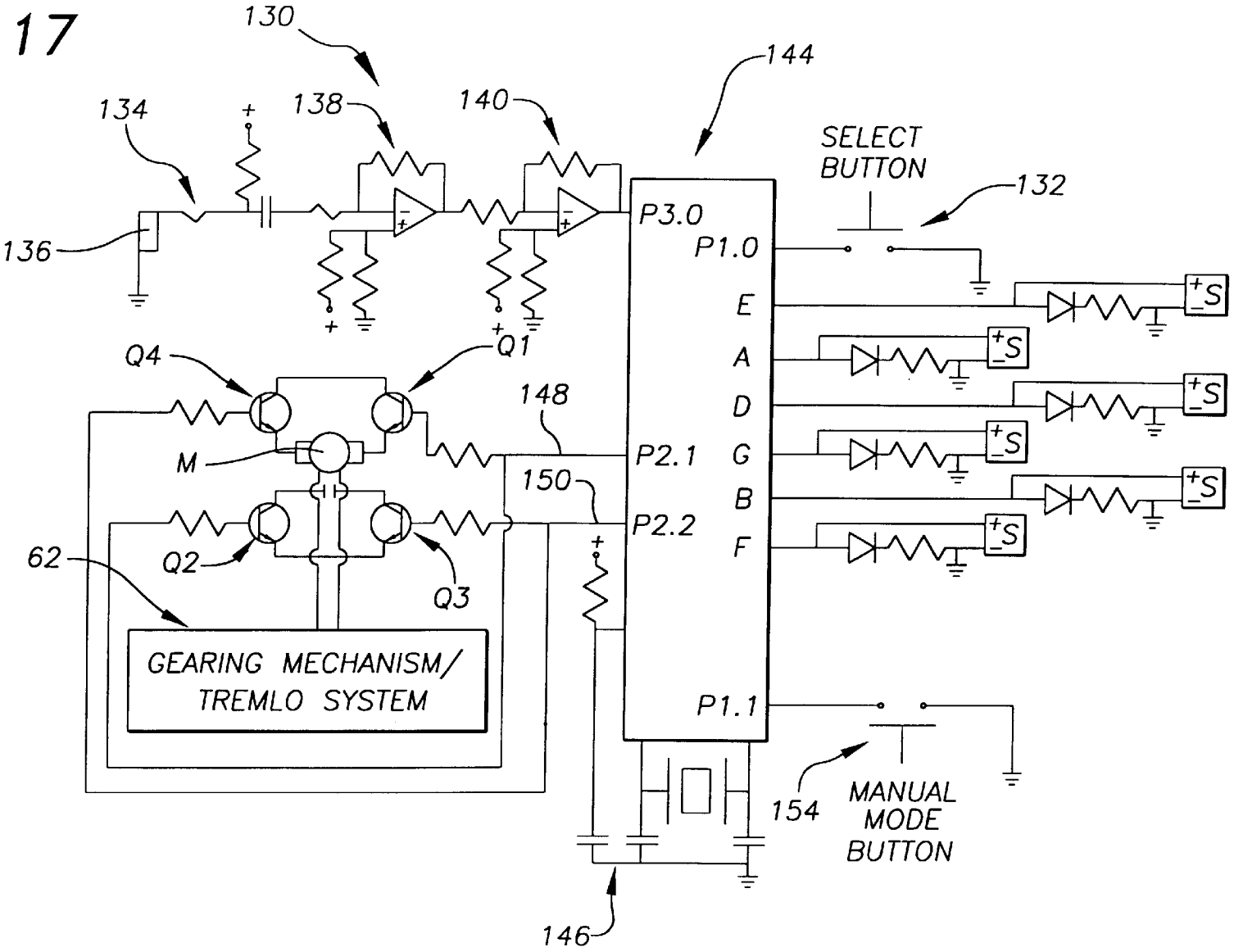
FIG. 17 is a schematic of the automatic string tuning circuit.

Referring now more particularly to FIG. 17, the electronic circuit 130 is turned on by depressing the select button 132 on the instrument 10, and a signal is provided by plucking a string. The signal is detected by a standard pickup or transducers 134 or an electric pick up connector 136 hard wired to the tuner 22 housed in the instrument body 12. The signal is amplified, filtered and shaped at 138, and the analog changed to digital and fed to a converter 140. This signal is detected on wire 142 by a microprocessor 144. The microprocessor is an 8 bit CMOS microcontroller with A/D converter #PIC16C7X and distributed by Digi-Key Corporation, Thief River Falls, Minn. 56701. The conventional circuit 146 provides the required voltages and timing signals for controlling the microprocessor operation. The microprocessor samples the wave form for analyses. The resulting frequency is time domain calculated from the pulses of an oscillating crystal in the circuit by averaging a series of wave forms, or by processing signals, in a time frequency domain transformation algorithm.

The signal is compared with a set of predetermined frequency values programmed in the microprocessor memory. When the closest intended frequency is determined solenoid S is energized to engage the corresponding string 18 with a separate motor driven gear train assembly 62. Output from the microprocessor is provided on wires 148 and 150 for driving a motor M in clockwise or counterclockwise directions. The wire 148 supplies base current to transistors Q1 and Q2 for connecting voltage of one polarity to the motor M. Similarly the other wire 150 supplies base current to the transistors Q3 and Q4 for connecting voltage of an opposite polarity to the motor M. The motor angularly rotates the string connected component a proportional amount related to the difference in the detected frequency and the desired frequency. The number of steps necessary to tune the string may be controlled by a dampening circuit which incrementally controls the steps as the input signal is sampled until the string is in tune. This allows a range of steps that will meet the same criteria in tuning the instrument. When the string is in tune, the solenoid S is deactivated, and the cycle can be repeated for a subsequent string.

Figure 18:
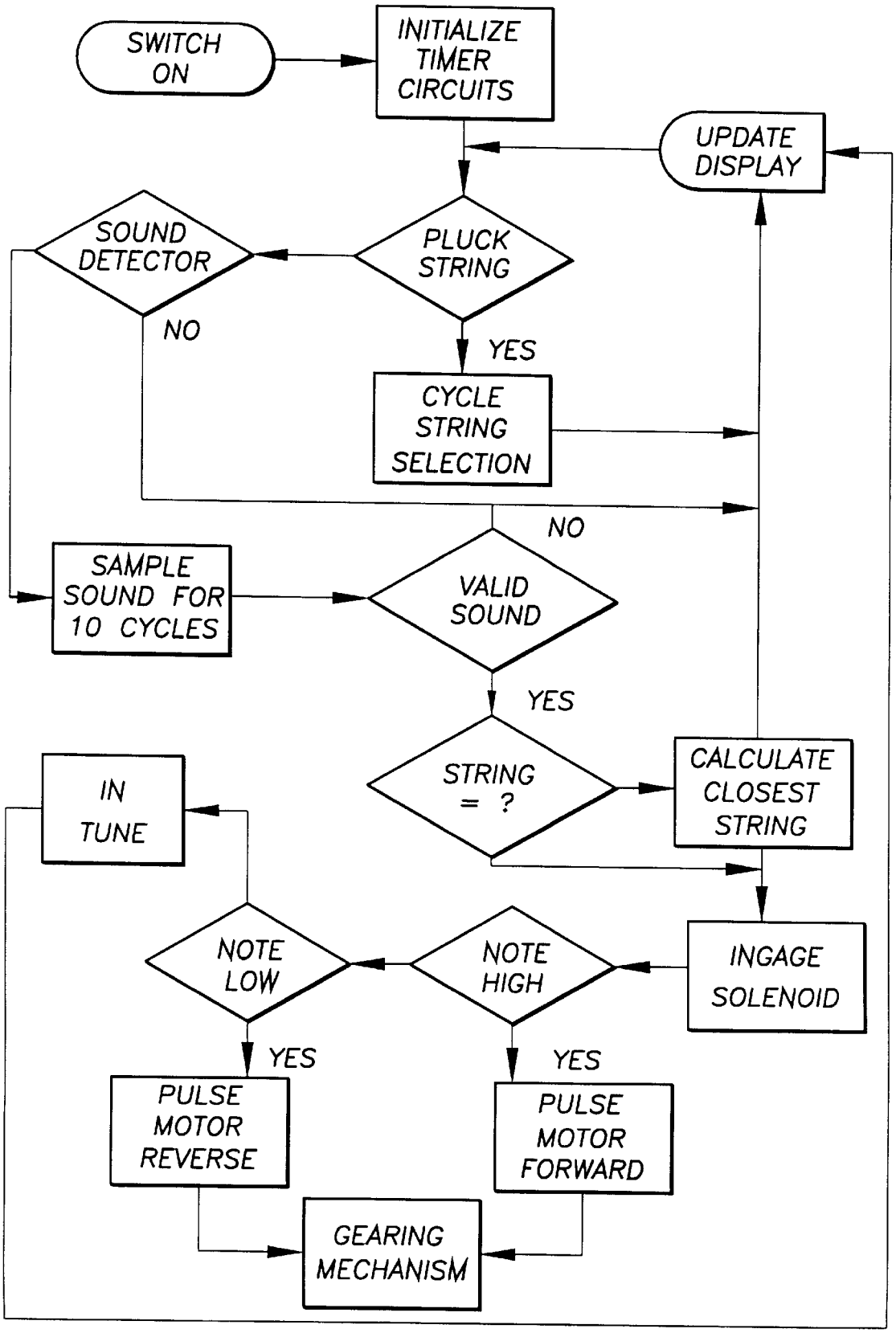
FIG. 18 is a flow chart of the microprocessor program.

The above described sequence is shown in flow sheet form by FIG. 18.

The above description of operation is intended principally for tuning the instrument and not for continuous tuning during play. However, continuous tuning during play may be accomplished by attaching electronic sensors at the saddle 34 for each string. When a particular string is plucked, a signal is sent to the microprocessor identifying the particular string while simultaneously sampling through the pickups or transducers, only the open tune frequency for a given string. The microprocessor searches for matching data, namely the proper string in a frequency that falls in the window of the predetermined open tune frequency for that string. All other information, such as fretted strings and their frequency, are ignored when sufficient samples are obtained for a given string, testing the program criteria to sample that string's preprogrammed open tune frequency. A comparison would be made, and if the string needs tuning a solenoid engages the string through the gear train to allow a separate motor gear train to accomplish its function.

During continuous play, all strings are being monitored to meet the programmed criteria by the microprocessor, and will only actively attempt to tune one string at a time, in the order information has been received.

Obviously, this system preferably includes a digital display, not shown, on the face 13 of the instrument body or different color diodes acknowledged by the musician as the instrument is being played relating to the tuned condition of each string. Also, it is desirable that a manually activated button, 54 (FIG. 1 and 17) or switch for selecting different programming options be provided for various types of tuning, and the ability to override the automatic tuning mode, to manually select which string to tune for use when installing new strings.

OPERATION

For replacing a broken string or adding a new string, the broken or old string is removed from both ends of the guitar. When one or more strings are to be replaced, the remaining strings will stay in tune by the double hinge tremolo mechanism 22. Insert the knot end of the new string over its saddle 34 and through the slot 61 on the string anchor 66 in the double hinge tremolo mechanism 22. Attach the other end of the string to the locking compound screw tuning peg assembly 94 as described hereinabove.

When the string has been manually tightened by the locking compound screw tuning peg 94 (FIG. 12) to near the desired frequency, activate the automatic tuning sequence 130 by depressing the power button 132 next to the string and frequency display, not shown, on the top face 17 of the instrument. Select the tuning type desired, such as standard D tuning by scrolling through the selections on the display. When the desired string is selected, pluck the string, and the tuner performs its above described tuning function. After the string has been replaced and tuned, the tuner can remain in the automatic setting, or switched back to standard setting. The standard setting is achieved by pressing the string selection button and scrolling through the display to the setting that reads "standard".

In the standard setting, all data is compiled while playing. When the musician elects to check tuning, the display will indicate which strings need tuning. If a fully automatic selection is desired, all strings are continuously monitored and maintained tuned while playing the strings.

Obviously the invention is susceptible to changes or alterations without defeating its practicability. Therefore, I do not wish to be confined to the preferred embodiment shown in the drawings and described herein.

I claim:

1. In combination an automatic tuning and tremolo system for a musical instrument having a plurality of strings and having a recess in its face surface adjacent one end of said plurality of strings, the improvement comprising:

a tremolo plate overlying the recess and hingedly mounted at one side edge of said face surface of said instrument adjacent a marginal edge of the recess for vertical pivoting movement of said plate toward and away from said face surface;

spring means normally maintaining said plate adjacent said face surface;

tension adjustment means comprising a string saddle and anchor means mounted on said plate and connected with one string of said plurality of strings for adjusting the tension on said one string, said anchor means comprising:

a threaded shaft supported by said tremolo plate for angular rotation in opposing directions about its longitudinal axis; a string anchor threadedly surrounding one end portion of said threaded shaft for movement of said anchor toward and away from said string in response to angular rotation of said shaft;

a first bevel gear axially secured to the other end portion of said threaded shaft;

gear means disposed in the recess normal to said plate and engageable with said anchor means for moving the latter;

detection means for detecting a musical tone produced by said one string and produce a signal;

converter means for converting said signal to a digital signal;

processor means for converting said digital signal to a frequency signal and comparing said frequency signal to a predetermined frequency value and producing an electrical signal;

solenoid means and motor and gear train means simultaneously energized by said electrical signal for operatively engaging said gear means with said tensioning means and adjusting said string frequency signal to correspond with said predetermined value;

said gear means and said motor and gear train means including:

a gear shaft axially normal to and moveable toward and away from said plate;

a second bevel gear on one end of said gear shaft for angularly rotating said threaded shaft;

a solenoid secured to the other end of said gear shaft for meshing said second bevel gear with said first bevel gear; and, gearmotor means driveably connected with said gear shaft.

2. The combination according to claim 1 in which said string saddle includes:

a string support base interposed between said one string and the adjacent surface of said tremolo plate in longitudinal alignment with said string anchor;

screw means for manually moving said base longitudinally of said string;

spool means secured to said base for supporting an intermediate portion of said string; and, other screw means on said base for raising and lowering said spool relative to the adjacent surface of said tremolo plate.

3. In combination an automatic tuning and tremolo system for a musical instrument having a plurality of strings and having a recess in its face surface adjacent one end of said plurality of strings, the improvement comprising:

a tremolo plate overlying the recess and hingedly mounted at one side edge of said face surface of said instrument adjacent a marginal edge of the recess for vertical pivoting movement of said plate toward and away from said face surface;

spring means normally maintaining said plate adjacent said face surface;

tension adjustment means comprising a string saddle and anchor means mounted on said plate and connected with one string of said plurality of strings for adjusting the tension on said one string;

gear means disposed in the recess below said plate and engageable with said anchor means for moving the latter;

detection means for detecting a musical tone produced by said one string and produce a signal;

converter means for converting said signal to a digital signal;

processor means for converting said digital signal to a frequency signal and comparing said frequency signal to a predetermined frequency value and producing an electrical signal;

solenoid means and motor and gear train means simultaneously energized by said electrical signal for operatively engaging said gear means with said tensioning means and adjusting said one string frequency signal to correspond with said predetermined value;

said anchor means including:

a threaded shaft supported by said tremolo plate for angular rotation in opposing directions about its longitudinal axis;

a string anchor threadedly surrounding one end portion of said threaded shaft for movement of said anchor toward and away from said string in response to angular rotation of said threaded shaft;

a first bevel gear axially secured to the other end portion of said threaded shaft, said gear means and said motor and gear train means including:

a gear shaft axially normal to and moveable toward and away from said plate;

a second bevel gear on one end of said gear shaft for angularly rotating said threaded shaft;

a solenoid secured to the other end of said gear shaft for meshing said second bevel gear with said first bevel gear; and, gearmotor means driveably connected with said gear shaft.

* * * * *